United States Patent [19]

Cairns

[11] Patent Number: 4,991,884

[45] Date of Patent: Feb. 12, 1991

[54] SELF-PRESENTING SECONDARY HOOD LATCH RELEASE AND HOOD POP-UP

[75] Inventor: Donnell A. Cairns, Columbia, Tenn.

[73] Assignee: General Motors Corporation, Detroit, Mich.

[21] Appl. No.: 561,390

[22] Filed: Aug. 1, 1990

[51] Int. Cl.[5] ..... E05B 3/00

[52] U.S. Cl. ..... 292/28; 74/501.6; 292/DIG. 14; 292/336.3

[58] Field of Search ..... 74/501.6; 292/24, 28, 292/336.3, DIG. 14, 225, 235, 171, 125, 141

[56] References Cited

U.S. PATENT DOCUMENTS

| | | | |
|---|---|---|---|
| 2,807,491 | 9/1957 | Deeley-Jones | 292/DIG. 14 X |
| 3,743,335 | 7/1973 | Reilhac et al. | 292/DIG. 14 X |
| 3,966,244 | 6/1976 | Kleisser et al. | 292/127 |
| 3,972,549 | 8/1976 | Valade | 292/DIG. 14 X |
| 4,706,478 | 11/1987 | Swan et al. | 292/336.3 X |
| 4,756,562 | 7/1988 | Foster et al. | 292/28 |
| 4,917,417 | 4/1990 | Aubry | 292/DIG. 14 X |

*Primary Examiner*—Richard E. Moore

*Attorney, Agent, or Firm*—Raymond I. Bruttomesso, Jr.

[57] ABSTRACT

A pop-up and release handle mechanism has a pop-up support rod slideably connected to a vehicle body panel for movement between a retracted position and an extended position as a vehicle closure panel moves from a closed position toward an opened position. A pop-up spring is anchored between the vehicle body panel and the pop-up support rod for urging the pop-up support rod from the retracted position to the extended position and for urging the vehicle closure panel towards the opened position. A secondary latch handle, carried by a self-presenting bracket, is connected to the secondary latch by a flexible push-pull cable for releasing the secondary latch allowing movement of the vehicle closure panel to the opened position. The self-presenting bracket is pivotally attached to the pop-up support rod for movement with the pop-up support rod and is guided from a retracted position beneath the closure panel to an extended position extended from the closure panel as the pop-up support rod moves from the retracted position to the extended position by a pivot rod mounted on the body panel. Thereby when a primary latch is released allowing the pop-up spring to urge the closure panel toward the open position and the closure panel is limited by the secondary latch, the self-presenting bracket which is connected to the pop-up support rod moves the secondary latch handle from the retracted position beneath the closure panel to the extended position extend from the closure panel where the secondary latch handle is accessible by the operator.

3 Claims, 3 Drawing Sheets

SELF-PRESENTING SECONDARY HOOD LATCH RELEASE AND HOOD POP-UP

This invention relates to a hood latch and more particularly to a hood latch having a secondary latch release handle that is presented upon the releasing of a primary hood latch.

BACKGROUND OF THE INVENTION

It is known to have a hood latch assembly including a primary latch which may be released from the interior of the vehicle as desired and a secondary latch which engages a striker to limit the upward movement of the hood after the primary latch is released.

It is also known to provide a handle under the hood for operating the secondary latch to allow full opening of the hood. The hood is biased upwardly when the primary latch is released, thereby leaving a small gap or opening into which a person may extend their hand to grasp the handle and operate the secondary latch. The location of this handle for the secondary latch is not the same from model to model due to differences in design and may be difficult to reach.

It is known to provide a release lever on the secondary latch, where the release lever is presented upon unlatching of the primary latch. Such a release lever is mechanically attached through linkages to the secondary latch.

It would be desirable to provide a secondary hood latch handle which is presented when the closure panel is raised to a secondary latch position and connected to a secondary latch by a flexible push-pull cable.

SUMMARY OF THE INVENTION

This invention provides a vehicle body panel having a closure panel hinged for movement between opened and closed positions, where a primary latch retains the closure panel in the closed position and is releasable to allow movement of the closure panel from the closed position toward the opened position. A secondary latch limits further movement towards the opened position of the vehicle closure panel upon partial opening movement of the vehicle closure panel subsequent to release of the primary latch. A pop-up and release handle mechanism has a pop-up support rod slideably connected to the vehicle body panel for movement between a retracted position and an extended position as the vehicle closure panel moves from the closed position toward the opened position. A pop-up spring is anchored between the vehicle body panel and the pop-up support rod for urging the pop-up support rod from the retracted position to the extended position and for urging the vehicle closure panel towards the opened position. A secondary latch handle is connected to the secondary latch by a flexible push-pull cable for releasing the secondary latch allowing movement of the vehicle closure panel to the opened position. A pivot rod is mounted on the vehicle body panel. A self-presenting bracket has a first end pivotally attached to the pop-up support rod for movement with the pop-up support rod. A second end of the self-presenting bracket carries the secondary latch handle. A center region of the self-presenting bracket has a slot adapted to receive the pivot rod for guiding the self-presenting bracket from a retracted position beneath the closure panel to an extended position extended from the closure panel as the pop-up support rod moves from the retracted position to the extended position. Thus, release of the primary latch allows the pop-up spring to urge the closure panel toward the open position and the self-presenting bracket moves the secondary latch handle from the retracted position beneath the closure panel to the extended position extend from the closure panel where the secondary latch handle is accessible by the operator.

One object, feature and advantage of the invention resides in a flexible push-pull cable that connects a secondary latch to a secondary latch handle, for releasing the secondary latch allowing movement of the vehicle closure panel to the opened position when the secondary latch handle is an the extended position, where the secondary latch handle is guided from a retracted position beneath the closure panel to an extended position extended from the closure panel when the primary latch is released.

Another object, feature and advantage of the invention resides in a self-presenting bracket having a first end pivotally attached to a pop-up support rod, a second end carries a secondary latch handle, and a center region having a slot for receiving a pivot rod, whereby the pivot rod guides the self presenting bracket from a retracted position beneath the closure panel to an extended position extended from the closure panel as the pop-up support rod moves from the retracted position to the extended position.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
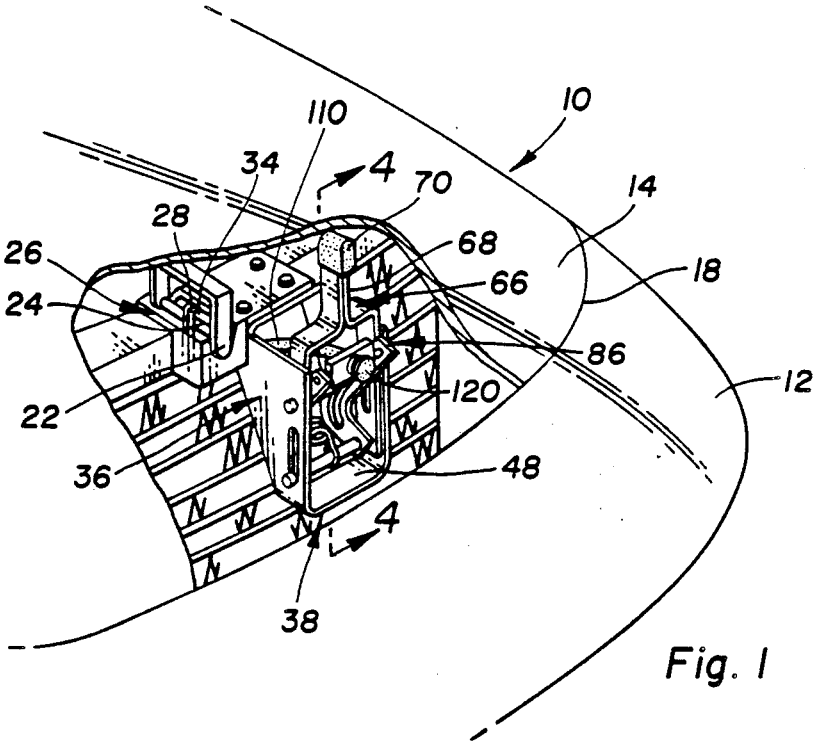
FIG. 1 is a fragmentary perspective view of the forward portion of the vehicle with the hood in the closed position.
Figure 2:
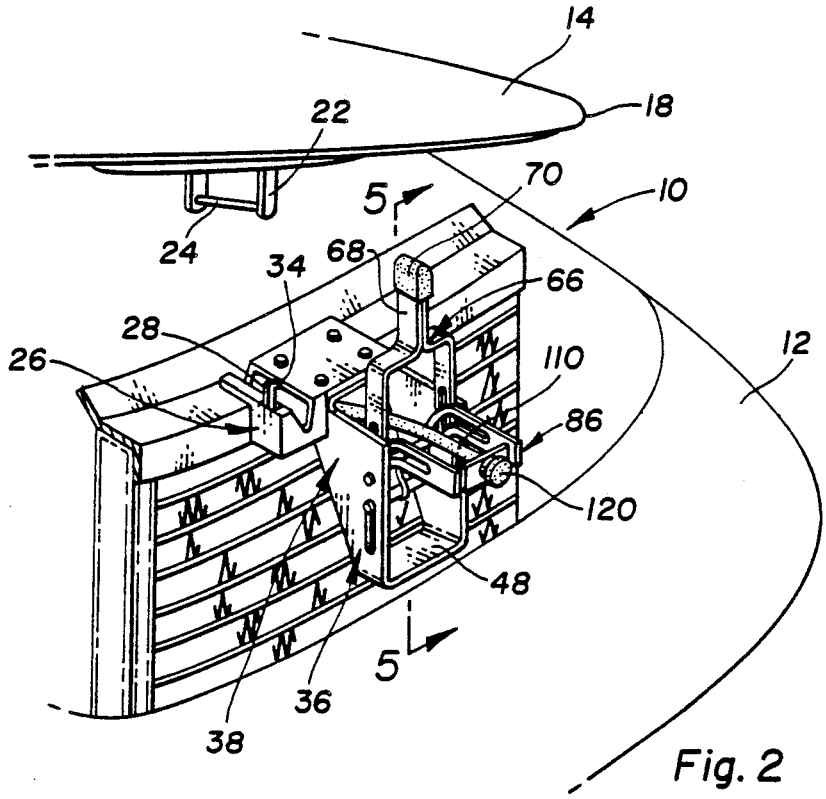
FIG. 2 is a perspective view of the forward portion of the vehicle with the hood in the opened position and a pop-up and release mechanism in a released position.

A motor vehicle 10 has a closure panel or hood 14 pivotally mounted thereon for movement between an opened position of FIG. 2 and a closed position of FIG. 1. A primary latch mechanism, not shown, disengageably connects a non-hinged end 18 of the closure panel 14 to a vehicle panel 12 for allowing movement from the closed position to the opened position.

A striker 22 mounted on the closure panel 14 has a striker post 24 as seen in FIG. 1.

Referring to FIG. 2, a secondary latch 26 is mounted to the vehicle panel 12 and has a rotatable latch lever 28 for engaging the striker post 24 to limit the upward movement of the closure panel 14 after the primary latch mechanism has been released. A torsion spring, not shown, biases the latch lever 28 in a clockwise direction toward engagement with the striker post 24.

Figure 3:
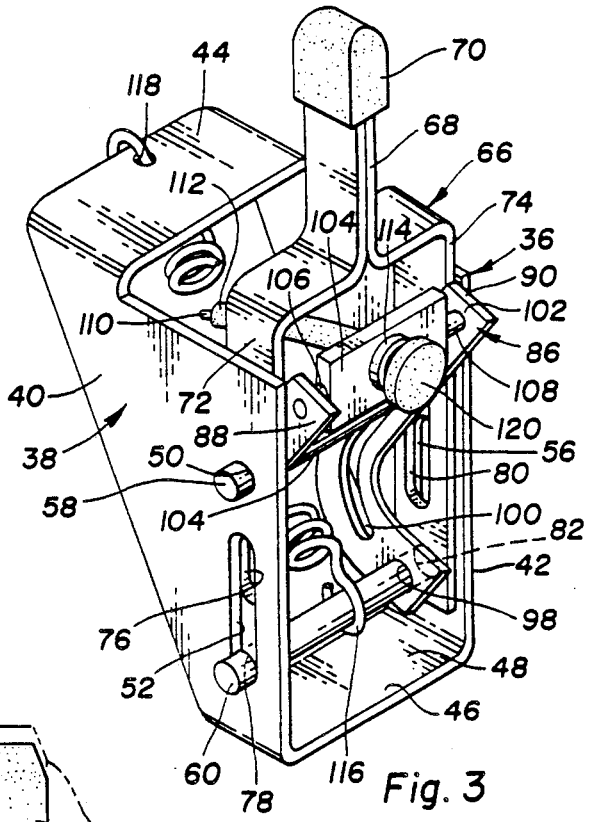
FIG. 3 is a perspective view of a pop-up and release handle mechanism in a retracted position.

A pop-up and release handle mechanism 36 has a housing 38 mounted to the vehicle panel 12 as seen in FIG. 2. As best seen in FIG. 3, the housing 38 has a left support 40 and a right support 42 connected by a top support 44 and a bottom support 46 which defines a pocket 48. The left support 40 has a hole 50 and a slot 52 located directly below the hole 50. The right support 42 also has a hole 54 and a slot 56.

A pivot rod 58 is securely mounted in the holes 50 and 54 of the left and right supports 40 and 42 and extends across the pocket 48. A slideable rod 60 is slideably received by the slots 52 and 56 of the left and right supports 40 and 42 for movement up and down in the slots 52 and 56.

Figure 5:
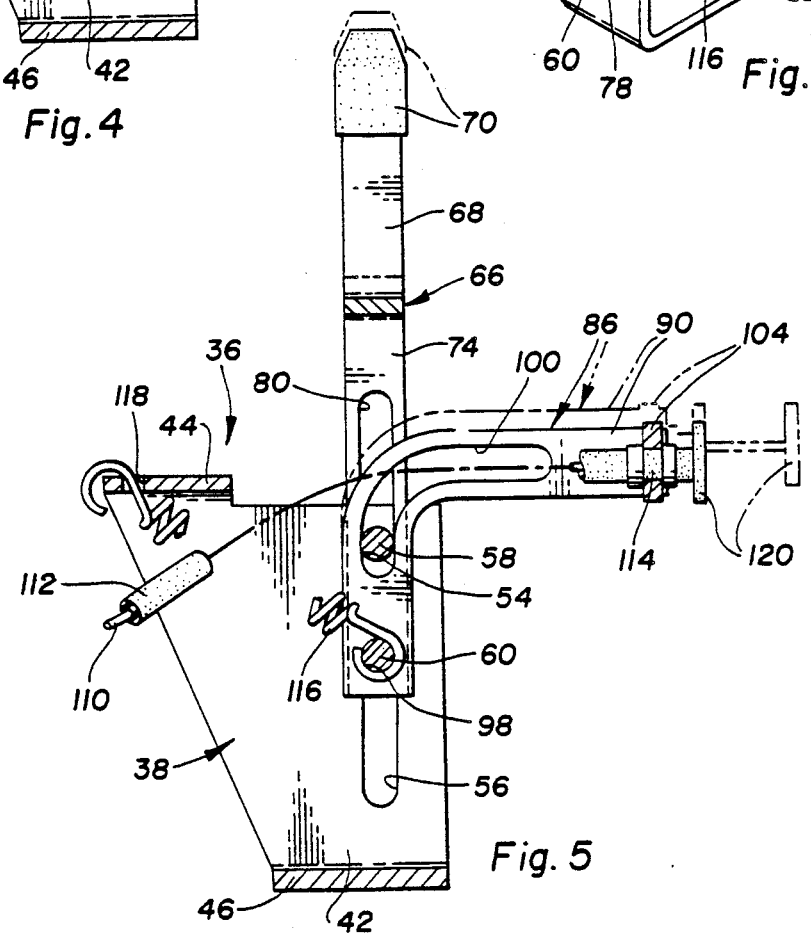
FIG. 5 is a sectional view taken in the direction of arrows 5—5 of FIG. 2 of the pop-up and release handle mechanism in an extended position. The pop-up and release handle mechanism is shown in phantom in the released position.

Referring to FIG. 3, the pop-up and release handle mechanism 36 has a pop-up support rod 66 and a handle presenter 86. The pop-up support rod 66 is received in the pocket 48 and has a push rod 68 which projects above the housing 38 and is capped by a rubber cap 70 which is engageable with the closure panel 14 as discussed below. The pop-up support rod 66 has a left leg 72 and a right leg 74 that depend from the push rod 68 and are juxtaposed to the left and right supports 40 and 42 respectfully. The left leg 72 has a slot 76 and a hole 78 (FIG. 3) directly below the slot 76. The right leg 74 has a slot 80 and hole 82 as seen in FIG. 3 and similarly position as the left leg 72. The slideable rod 60, which is slideably received by the slots 52 and 56 in the left and right supports 40 and 42, extends through and rotatably relative to the holes 82 and 78, in the legs 72 and 74 of the pop-up support rod 66, so that the pop-up support rod 66 moves up and down with the slideable rod 60. The pivot rod 58, which is securely mounted in the holes 50 and 54 of the left and right supports 40 and 42, extends through the slots 76 and 80 in the legs 72 and 74 of the pop-up support rod 66 for guiding the movement of the pop-up support rod 66. The pop-up support rod 66 is able to move from a retracted position as shown in FIG. 3 through an extended position as shown in FIG. 5 to a released position as shown in phantom in FIG. 5.

Figure 4:
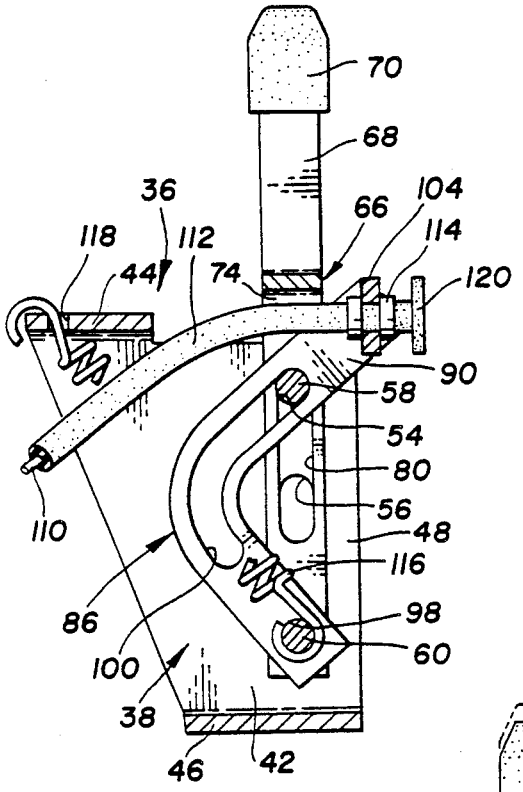
FIG. 4, is a sectional view taken in the direction of arrows 4—4 of FIG. 1 of the pop-up and release handle mechanism in the retracted position.

The handle presenter 86 is also located in the pocket 48 and has an "L" shape left self-presenting bracket 88, an "L" shape right self-presenting bracket 90, and a handle holder 104 as best seen in FIG. 3. The right self-presenting bracket 90 has a hole 98 for the slideable rod 60 to extend through at one end and a slot 100 located on the bend of the "L" for the pivot rod 58 to extend through. The left self-presenting bracket 88 similarly has a hole and a slot, both not shown. The self-presenting brackets 88 and 90, located just inside of the legs 72 and 74 of the pop-up support rod 66, move together defining for the handle presenter 86 a retracted position as shown in FIG. 4, an extended position as shown in FIG. 5 and a released position as shown in phantom in FIG. 5.

As best seen in FIG. 3, the handle holder 104 is pivotally mounted on the self-presenting brackets 88 and 90 by a pair of swivel pins 106 and 108.

A flexible push-pull cable 110 extends from the latch lever 28 of the secondary latch 26 through the handle holder 104 to a secondary latch handle 120. A sheath 112 which surrounds the push-pull cable 110 has a plastic end 114 for mounting to the handle holder 104 as shown in FIG. 5. The secondary latch handle 120 moves from an engaged position shown in FIG. 5 to a released position shown in phantom in FIG. 5 which causes the latch lever 28 of the secondary latch 26 to rotate counterclockwise.

A pop-up spring 116 has ends anchored respectively on the slideable rod 60 and a hole 118 in the top support 44 of the housing 38. The pop-up spring 116 biases the pop-up and the release mechanism 36 towards the released position shown in phantom in FIG. 5.

Referring to FIG. 1, to open the closure panel 14, the primary latch mechanism is unlatched allowing the closure panel 14 to move upward. The pop-up spring 116 is thus able to urge the pop-up support rod 66 upward, being no longer limited by latched closure panel 14 which engages the rubber cap 70 of the push rod 68. The pop-up support rod 66 connected to the slideable rod 60 and guided by the pivot rod 58 lifts the closure panel 14 upward. The upward movement is stopped when the striker post 26 engages the latch lever 28 of the secondary latch 26. The handle presenter 86 which is also connected to the slideable rod 60 and guided by the pivot rod 58 moves at the same time towards the extended position shown in FIGS. 2 and 5.

With the handle presenter 86 in the extended position shown in FIGS. 2 and 5, the operator can grip and pull the secondary latch handle 120 to the release position shown in phantom in FIG. 5. This movement causes the flexible push-pull cable 110 to rotate the latch lever 28 of the secondary latch 26 counterclockwise. As the latch lever 28 of the secondary latch 26 rotates out of the path of the striker post 24, the pop-up support rod 60 urged by the pop-up spring 116 moves the closure panel 14 upward slightly until the pivot rod 58 reaches the end of travel in the slots 76 and 80 in the legs 72 and 74 of the pop-up support rod 66. The handle presenter 86 which is connected to the pop-up support rod 60 by the slideable rod 60 moves at the same time from the extended position shown in FIG. 5 to the released position shown in phantom in FIG. 5. When the operator releases the secondary latch handle 120, the secondary latch spring returns the latch lever 28 back to the position shown in FIG. 2. The closure panel 14 may then be lifted to a fully opened position.

Referring to FIG. 2, when the closure panel 14 is lowered, the striker post 24 comes in contact with a curved surface 34 of the latch lever 28 and pushes against the curved surface 34 forcing the latch lever 28 counterclockwise. When the striker post 24 passes below the curved surface 34 the secondary latch spring forces the latch lever 28 back into its original position shown in FIG. 1, with the striker post 24 engaged by the hook portion 30 of the latch lever 28. The secondary latch handle 120 would have to be pulled again if the closure panel 14 were to be moved to the fully opened position.

As the same time, the closure panel 14 makes contact with the rubber cap 70 of the push rod 68. As the closure panel 14 causes the pop-up support rod 66 to move from the released position as shown in phantom in FIG.

5 through the extend position shown in FIG. 5 to the retracted position shown in FIG. 4, the slideable rod 60, which guide the pop-up support rod 66, moves down in the slots 52 and 56 in the left and right supports 40 and 42. The handle presenter 86 which is rotatably attached at one end of the self-presenting brackets 88 and 90 to the slideable rod 60 moves at the same time from the released position through the extended position to the retracted position. The pivot rod 58, which passes through the slots 100, only one shown, in the self-presenting brackets 88 and 90, guides the handle presenter 86 as it moves. The primary latch mechanism engages the closure panel 14 in the closed position.

The pop-up spring 116 in the pop-up and release handle mechanism 36 biases the slideable rod 60 to move upward in the slots 52 and 56 of the left and right supports 40 and 42, therefore when the primary latch is released again the closure panel 14 will move toward the opened position.

Figure 7:
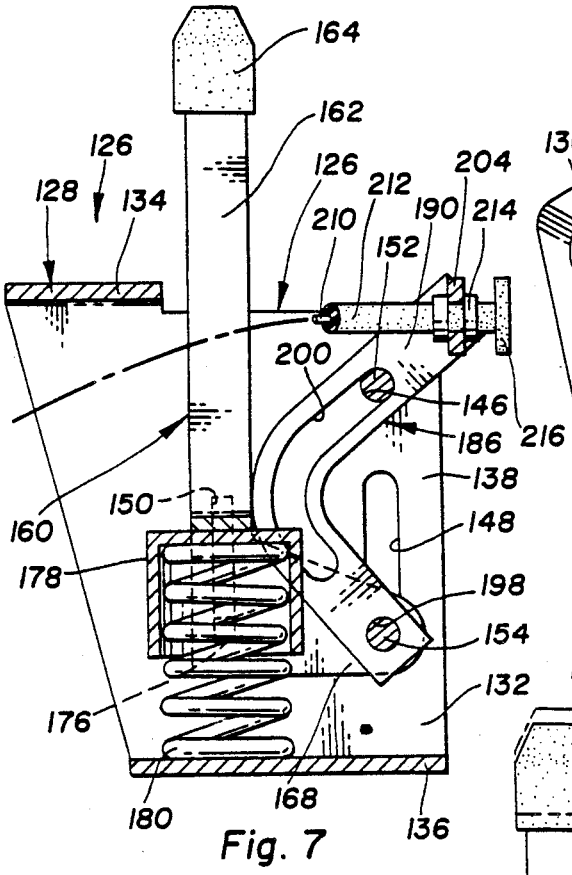
FIG. 7 is a sectional view similar to FIG. 4 of the second embodiment of the pop-up and release handle mechanism in the retracted position.
Figure 6:
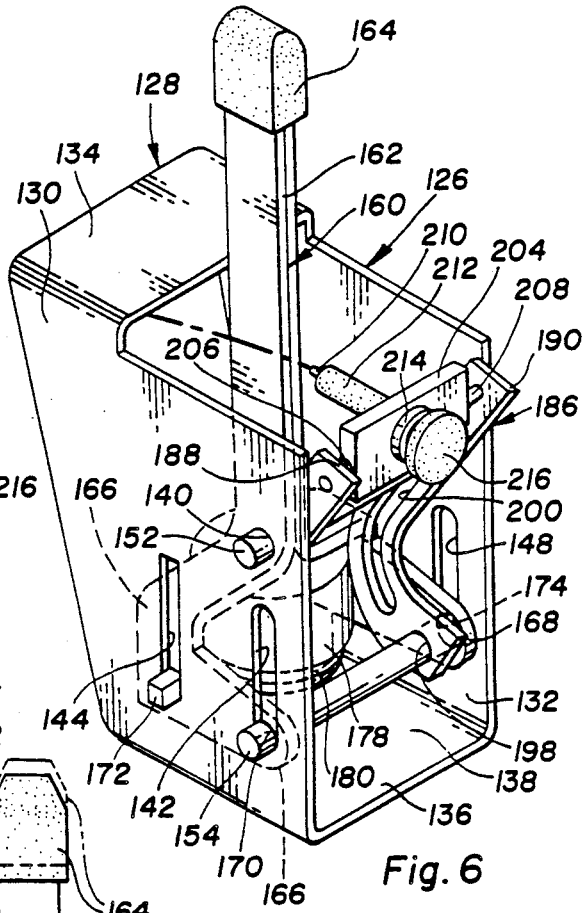
FIG. 6 is a perspective view of a second embodiment of a pop-up and release handle mechanism in a retracted position.
Figure 8:
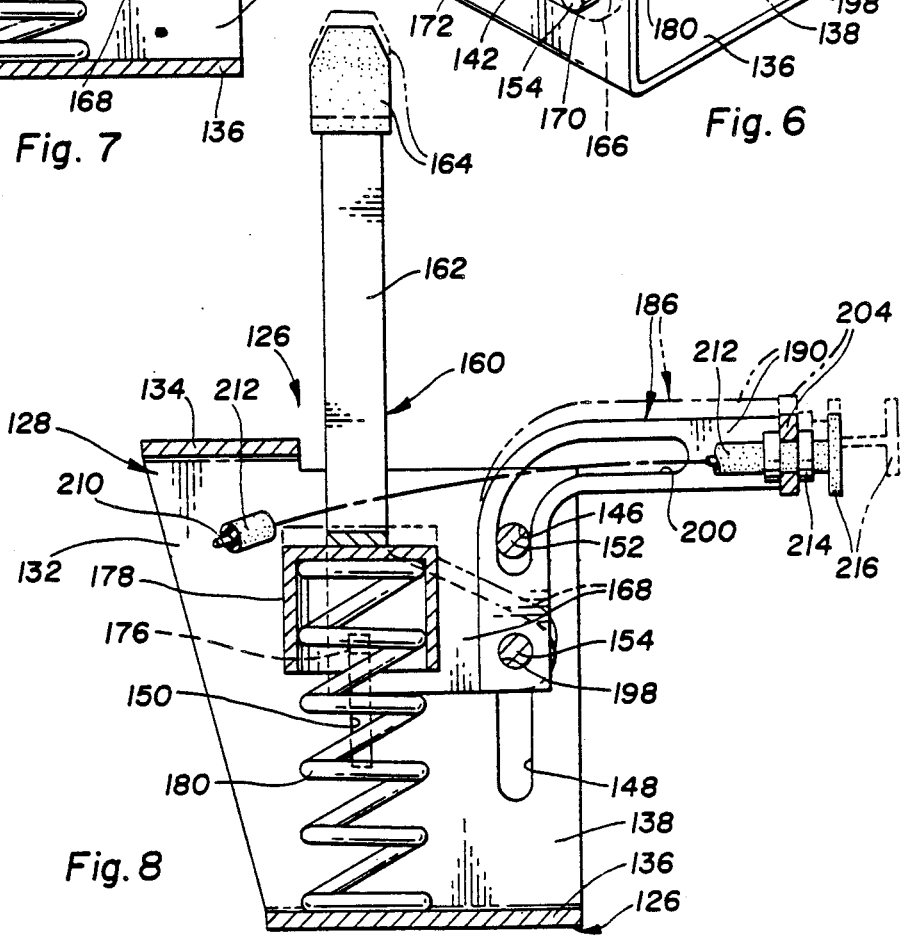
FIG. 8 is a sectional view similar to FIG. 5 of the second embodiment of the pop-up and release handle mechanism in an extended position. The pop-up and release handle mechanism is shown in phantom in the released position.

A second embodiment of the invention, shown in FIGS. 6, 7, and 8, is used in conjunction with a primary and secondary latches similar to the first embodiment and not shown. A pop-up and release handle mechanism 126 has a housing 128 mounted to the vehicle panel 12. As best seen in FIG. 6, the housing 128 has a left support 130 and a right support 132 connected by a top support 134 and a bottom support 136 which defines a pocket 138. The left support 130 has a hole 140 and a first slot 142 located directly below the hole 140 similarly to the first embodiment and in addition a second slot 144. The right support 132 also has a hole 146, a first slot 148 and a second slot 150 as shown in FIG. 7.

A pivot rod 152 is securely mounted in the holes 140 and 146 of the left and right supports 130 and 132 and extends across the pocket 138 as shown in FIG. 6. A slideable rod 154 is slideably received by the first slots 142 and 148 of the left and right supports 130 and 132 for movement up and down in the slots 142 and 148.

Referring to FIG. 6, the pop-up and releasable mechanism 126 has a pop-up support rod 160 and a handle presenter 186. The pop-up support rod 160 is received in the pocket 138 and has a push rod 162 which projects above the housing and is capped by a rubber cap 164 which is engageable with the closure panel 14 similar to the first embodiment. The pop-up support rod 160 has a left leg 166 and a right leg 168 that depend from the push rod 162 and are in proximity to the left and right supports 130 and 132 respectfully. The left leg 166 has a hole 170 and a tab 172. The right leg 168 has a hole 174 and a tab 176 as seen in FIG. 8 and similarly position as the left leg 166. The slideable rod 154, which is slideably received by the first slots 142 and 148 in the left and right supports 130 and 132, extends through and rotatably relative to the holes 170 and 174 in the legs 166 and 168 of the pop-up support rod 160, so that the pop-up support rod 160 moves up and down with the slideable rod 154. The tabs 172 and 176 that project from the legs 166 and 168 of the pop-up support rod 160 are slideably received by the second slots 144 and 150 in the left and right supports 130 and 132 and guide the movement of the pop-up support rod 160. The pop-up support rod 160 is able to move from a retracted position as shown in FIG. 7 through an extended position as shown in FIG. 8 to a released position as shown in phantom in FIG. 8. Referring to FIG. 6, a spring can 178 is securely fixed between the legs 166 and 168 in line with the tabs 172 and 176 and directly below the push rod 162.

A pop-up spring 180 is mounted between the bottom support 136 of the housing 128 and the spring cans 178. The pop-up spring 180 biases the pop-up support rod 160 towards the released position shown in phantom in FIG. 8.

The handle presenter 186 is similar to the first embodiment and is located in the pocket 138 and has an "L" shape left self-presenting bracket 188, an "L" shape right self-presenting bracket 190, and a handle holder 204 as best seen in FIG. 6. The right self-presenting bracket 190 has a hole 198 for the slideable rod 154 to extend through at one end and a slot 200 located on the bend of the "L" for the pivot rod 152 to pass through. The left self-presenting bracket 188 similarly has a hole and a slot, both not shown. The self-presenting brackets 188 and 190, located just inside of the legs 166 and 168 of the pop-up support rod 160, move together defining for the handle presenter 186 a retracted position as shown in FIG. 7, an extended position as shown in FIG. 8 and a released position as shown in phantom in FIG. 8.

As best seen in FIG. 6, the handle holder 204 is pivotally mounted on the self-presenting brackets 188 and 190 by a pair of swivel pins 206 and 208.

A flexible push-pull cable 210 extends from the latch lever 28 of the secondary latch 26 through the handler holder 204 to a secondary latch handle 216. A sheath 212 that surrounds the push-pull cable 210 has a plastic end 214 for mounting to the handle holder 204 as seen in FIG. 8. The secondary latch handle 216 moves between an engaged position shown in FIG. 8 and a release position shown in phantom in FIG. 8.

The opening and closing of the closure panel 14 is similar to the first embodiment.

While two embodiments of the present invention have been explained, various modifications within the spirit and scope of the following claims will be readily apparent to those skilled in the art.

The embodiments of the invention in which an exclusive property or privilege is claimed are defined as follows:

1. In a vehicle body having a closure panel hinged for movement between opened and closed positions, a primary latch means for retaining the closure panel in the closed position and being releasable to allow movement of the closure panel from the closed position toward the opened position, a secondary latch means for limiting further movement towards the opened position of the vehicle closure panel upon partial opening movement of the vehicle closure panel subsequent to release of the primary latch means, and a pop-up and release handle mechanism comprising;

a pop-up means for urging the vehicle closure panel towards the opened position;

a flexible push-pull cable;

a secondary latch means handle connected to the secondary latch means by the flexible push-pull cable; and presenter means connecting the pop-up means to the secondary latch means handle for moving the secondary latch means handle from a retracted position beneath the closure panel to an extended position extended from the closure panel as the closure panel moves from the closed position, whereby the secondary latch means handle is in the extended position, accessible by the operator to release the secondary latch means allowing movement of the vehicle closure panel to the opened position.

2. In a vehicle body panel having a closure panel hinged for movement between opened and closed positions, a primary latch means for retaining the closure panel in the closed position and being releasable to allow movement of the closure panel from the closed position toward the opened position, a secondary latch means for limiting further movement towards the opened position of the vehicle closure panel upon partial opening movement of the vehicle closure panel subsequent to release of the primary latch means, and a pop-up and release handle mechanism comprising;

a spring loaded support rod slideably connected to the vehicle body panel for movement from a retracted position to an extended position as the vehicle closure panel moves from the closed position toward the opened position and lifts the closure panel upon release of the primary latch;

a flexible push-pull cable;

a secondary latch means handle connected to the secondary latch means by the flexible push-pull cable for releasing the secondary latch means allowing movement of the vehicle closure panel to the opened position; and a self-presenting bracket movable mounted to the vehicle body panel and interposed between the secondary latch means handle and the spring loaded support rod for movement of the self-presenting bracket and secondary latch means handle with the spring loaded support rod between the retracted position and the extended position whereby the primary latch means is released allowing the spring loaded support rod to urge the closure panel toward the open position limited by the secondary latch means, the self-presenting bracket connected to the pop-up support rod moves the secondary latch means handle from the retracted position beneath the closure panel to the extended position extend from the closure panel where the secondary latch means handle is accessible by the operator.

3. In a vehicle body panel having a closure panel hinged for movement between opened and closed positions, a primary latch means for retaining the closure panel in the closed position and being releasable to allow movement of the closure panel from the closed position toward the opened position, a secondary latch means for limiting further movement towards the opened position of the vehicle closure panel upon partial opening movement of the vehicle closure panel subsequent to release of the primary latch means, and a pop-up and release handle mechanism comprising;

a pop-up support rod slideably connected to the vehicle body panel for movement between a retracted position and an extended position as the vehicle closure panel moves from the closed position toward the opened position;

a pop-up spring connected between the vehicle body panel and the pop-up support rod for urging the pop-up support rod from the retracted position to the extended position and for urging the vehicle closure panel towards the opened position;

a flexible push-pull cable;

a secondary latch means handle connected to the secondary latch means by the flexible push-pull cable for releasing the secondary latch means allowing movement of the vehicle closure panel to the opened position;

a pivot rod mounted on the vehicle body panel; and a self-presenting bracket having a first end pivotally attached to the pop-up support rod for movement with the pop-up support rod, a second end carrying the secondary latch means handle, and a center region having a slot adapted to receive the pivot rod for guiding the self-presenting bracket from a retracted position beneath the closure panel to an extended position extended from the closure panel as the pop-up support rod moves from the retracted position to the extended position whereby the primary latch means is released allowing the pop-up spring to urge the closure panel toward the open position limited by the secondary latch means, the self presenting bracket connected to the pop-up support rod moves the secondary latch means handle from the retracted position beneath the closure panel to the extended position extend from the closure panel where the secondary latch means handle is accessible by the operator.

* * * * *